United States Patent [19]

Philippart et al.

[11] Patent Number: 5,044,280

[45] Date of Patent: Sep. 3, 1991

[54] LINEAR HOLLOW CHARGE DEVICES

[75] Inventors: Daniel A. Philippart, Redhill; Peter J. Haskins, Kemsing, both of England

[73] Assignee: Secretary of State for Defence in Her Britannic Majesty's Government of the United Kingdom of Great Britain and Northern Ireland, London, United Kingdom

[21] Appl. No.: 476,395

[22] PCT Filed: Nov. 16, 1988

[86] PCT No.: PCT/GB88/01005

§ 371 Date: Jun. 5, 1990

§ 102(e) Date: Jun. 5, 1990

[87] PCT Pub. No.: WO89/04943

PCT Pub. Date: Jun. 1, 1989

[30] Foreign Application Priority Data

Nov. 17, 1987 [GB] United Kingdom ..... 8726912

[51] Int. Cl.[5] ..... F42B 1/00; F42B 1/02

[52] U.S. Cl. ..... 102/307; 102/308; 102/476; 102/318; 102/701; 175/4.6

[58] Field of Search ..... 102/307, 312, 313, 314, 102/306, 308, 309, 310, 476, 475, 701, 318; 89/1.15; 175/4.6, 2, 3; 166/55, 55.2

[56] References Cited

U.S. PATENT DOCUMENTS

| | | | |
|---|---|---|---|
| 3,136,249 | 6/1964 | Poulter | 102/24 |
| 3,211,094 | 10/1965 | Liddiard, Jr. | 102/22 |
| 3,238,019 | 3/1966 | DeCarli | 23/209.1 |
| 3,443,518 | 5/1969 | Cross | 102/24 |
| 4,187,782 | 2/1980 | Grace | 102/56 |

FOREIGN PATENT DOCUMENTS

| | | |
|---|---|---|
| 0254800 | 2/1988 | European Pat. Off. . |
| 842035 | 6/1951 | Fed. Rep. of Germany . |
| 1796234 | 8/1971 | Fed. Rep. of Germany . . |
| A2138111 | 10/1984 | United Kingdom . |
| A2176878 | 1/1987 | United Kingdom . |

*Primary Examiner*—Brooks H. Hunt
*Assistant Examiner*—Chrisman D. Carroll
*Attorney, Agent, or Firm*—Nixon & Vanderhye

[57] ABSTRACT

The device (10) consists of a bar (12) of high explosive having a planisymmetrical groove (20) along one side lined with a hollow charge liner (28). A pair of backing charges (34, 36) connected by a bridging charge (42) are disposed along the opposite side of the bar. Each backing charge is separated from the bar by a gap (38, 40) which tapers towards the common longitudinal periphery of the bar and charge. The surfaces of the backing charges facing the gaps are lined with liners (46, 48). A linear initiating charge (54) is separated from the bridging charge longitudinally of the device by a gap (61). The facing surface of the charge (54) is lined with a metal strip (58) which, when the charge is detonated, is projected across the gap (61) to initiate the bridging charge linearly. A detonation wave then propagates from the bridging charge down each backing charge towards its peripheral region, projecting the liners (46, 48) across the gaps (38, 40) to initiate the bar. A detonation wavefront is thereby initiated along the length of the opposite side of the bar (12) which then propagates through the bar to form the hollow charge liner (28) into a linearly-projected cutting jet of high penetration efficiency.

12 Claims, 3 Drawing Sheets

LINEAR HOLLOW CHARGE DEVICES

BACKGROUND OF THE INVENTION

1. Field of the Invention

This invention relates to linear hollow charge devices and in particular but not exclusively to linear cutting charge devices.

2. Discussion of Prior Art

Hollow charges, also commonly referred to as shaped charges, are known comprising a mass of explosive having a concavity in one of its surfaces, the concavity being lined with a ductile metal liner. Detonation of the charge violently comprises the ductile liner converting it into an outwardly-projected elongated jet of metal, the shape of which is largely dependent upon the shape of the concavity. The jet has powerful penetrating properties which are utilised by detonating the charge with its concavity adjacent and facing a surface to be penetrated i.e. the work surface. The degree of surface penetration is dependent upon the distance, known as the stand-off distance, between the charge and the work surface. The optimum value of this distance is normally determined by experiment.

Most known types of hollow charge device are axisymmetric in which the charge and its shaped cavity have circular symmetry about a fore-and-aft axis. The cavity is typically formed as reentrant hollow cone, and the correspondingly-axisymmetric jet penetrator formed from the collapsed liner is projected along the line of the axis. However, some types of hollow charge device are non-axisymmetric and are designed to produce non-axisymmetric jet penetrators.

One particular example of a non-axisymmetric hollow charge is disclosed in UK Patent Application No. GB2176878A, which discloses a linear cutting charge comprising an extruded bar, formed from a composite of explosive material and a first plastic material, having a longitudinal planisymmetrical cavity along its length in the form of a "V"-shaped groove which is lined with an extruded liner of a metal/plastic composite. The bar is enclosed in a non-metallic casing which includes a casing portion providing a barrier between the cavity and the working surface of a thickness equal to the optimum standoff distance for the cutting charge. Detonation of the bar produces a jet along the length of the groove which can be utilised for cutting purposes.

The detonation of a hollow charge is usually initiated by a single detonator located at the end of the charge remote from the concavity. In an axisymmetric hollow charge device, the detonator is usually located axially. However, since a single detonator will produce a generally spherical wavefront which propagates through the charge to strike the concave liner at a rather oblique angle, only a relatively small proportion of the energy in this detonation wavefront is transmitted to the liner so that a jet penetrator of relatively low penetration efficiency is formed and much of the available energy from the detonated charge is wasted. In a linear hollow charge device, this problem of low penetration efficiency is further complicated by the non-axisymmetrical shape of the charge. The spherical detonation wavefront generated from each of one or more detonators situated on or along the charge will strike the liner at different angles along the length of the charge. This leads to undesirable variations in the cutting efficiency of the jet formed along the length of the groove.

In a yet further design of a linear hollow charge device disclosed in British Patent Specification GB2138111A, the initiation of the device is controlled by providing the cutting charge in two parts consisting of an initiating charge and a main charge. The initiating charge has a cavity in one end lined with an inert transfer plate. The main charge, with its lined groove facing away from the initiating charge, is located within this cavity to leave a gap between the facing surfaces of the main charge and transfer plate. Initiation of the initiating charge projects the transfer plate across the gap to initiate the main charge. Initiation of the main charge is affected by such factors as the contours of the facing surface of the main charge and transfer plate, and the phase velocity $V_{Ph}$ at which the plate strikes the main charge across its surface. Single-point initiation of the initiating charge as disclosed in GB2138111A creates out-of-phase projection, both along and across the linear device, of the transfer plate towards the main charge, creating a complex pattern of initiation on the facing surface of the main charge. This in turn leads to poor penetrator performance.

SUMMARY OF THE INVENTION

One subject of the present invention is to provide a cutting charge device which overcomes the aforementioned problems associated with known point initiation of this type of charge, but which may still be initiated using a single detonator.

According to the present invention there is provided a linear hollow charge device comprising a longitudinal cutting charge of high explosive provided in one or more separate parts, a planisymmetrical groove along one side of the charge which is lined with a non-explosive hollow charge liner, and a means for initiating the cutting charge along its opposite side characterised in that the said means comprises a linear initiating charge of high explosive disposed along the plane of symmetry adjacent the opposite side of the cutting charge, the facing surfaces of the linear initiating and cutting charges defining a gap therebetween which is tapered longitudinally of the cutting charge from one end of the linear initiating charge to its other end, means for detonating the linear initiating charge at the said one end, and a non-explosive primary initiating liner on the facing surface of the linear initiating charge which, when the linear initiating charge is detonated, is projected across the gap to initiate the cutting charge along the plane of symmetry, the degree of taper of the gap being selected such that the phase velocity of cutting charge initiation by the projected initiating liner exceeds the velocity of detonation of the high explosive of the cutting charge.

The use of a linear initiating charge and primary initiating liner in accordance with this invention may on its own enhance the penetration performance of a simple, one part cutting charge. It provides a means by which from single point detonation of the linear charge, the phase velocity of initiation of the cutting charge by the projected initiating liner is made to exceed the velocity of detonation of the cutting charge. By the selection of an appropriate angle of taper, this phase velocity can be increased virtually to infinity which produces substantially instantaneous initiation of the cutting charge along its length. As phase velocity increases to infinity, the longitudinal dispersion of the jet beyond the ends of the detonated cutting charge diminishes and the explosive energy of the cutting charge is thereby concentrated into a jet of shorter cutting length, so that the ability of the jet to penetrate a target along that length of cut is enhanced.

The width of the linear initiating charge need only be a fraction of that of the cutting charge in order to effect linear initiation along the cutting plate. Only a relatively small amount of explosive is therefore required in the linear initiating charge.

The cutting charge preferably comprises at least two adjacent charges consisting of a main charge having a side with the planisymmetrical groove therein and a secondary charge disposed between the main and linear charges which, after initiation by the linear charge, initiates the main charge.

The facing surfaces of the main and secondary charges preferably define a gap therebetween, the facing surface of the secondary charge being lined with a non-explosive secondary initiating liner which, when the secondary charge is initiated, is projected across the gap into contact with the main charge to initiate the latter on its facing surface. In this arrangement, plane wave initiation of the main charge may be effected from single point detonation of the linear charge. The facing surface of the secondary charge preferably defines a cavity in which that side of the main charge remote from the groove is located.

The preferred spacial arrangement of the main and secondary charges is preferably such that the phase velocity of detonation of the main charge is, in any direction along its facing surface, greater than the velocity of detonation of the main charge. Most preferably, the phase velocity is such that a major portion of the surface area of the facing surface is initiated substantially simultaneously by the projected secondary charge liner.

The advantage of very high phase velocities of initiation at the facing surface of the main charge is that a detonation wavefront is formed below that surface which approximates to the shape of the surface itself. This wavefront will in turn produce a high phase velocity of collision with the hollow charge liner in the groove. If, as is preferred, the main charge is of substantially constant thickness normal to the surface of the groove, then this wavefront will travel through the charge to arrive at all parts of the of the linear virtually simultaneously, that is to say with almost infinite phase velocity of collision.

A high phase velocity of collision with the hollow charge liner promotes efficient transfer of energy to the liner and therefore enhances its ability to penetrate a target. Furthermore, if the main charge is of substantially constant thickness then the amount of energy transferred per unit area of liner will be approximately constant. This reduces the velocity gradient of the jet in a direction along its trajectory, which reduces its tendency to elongate and break up as it travels outwards from the detonated main charge and so maintains its ability to penetrate target material at some distance from the detonated device. This feature of the jet is of practical importance in situations where the device cannot easily be brought immediately adjacent the target material to be cut, a problem encountered in, for example, the field of demolition.

Production of a high (and preferably infinite) phase velocity of initiation of the cutting charge has been discussed above, and the transfer of that velocity from the secondary charge to the facing surface of the main charge can be achieved by maintaining a constant spacial relationship between these two charges along the length of the combined cutting charge. In order to produce additionally a high (and preferably infinite) phase velocity of initiation across the cutting plane at this facing surface, the gap between the main and secondary charges is preferably tapered at an acute angle in a direction away from the cutting plane.

The groove may be "V" shaped or rounded in cross section. A rounded, and especially a hemicylindrical, groove has the advantage over a"V" shaped groove that once formed into a jet penetrator by the detonated cutting charge the hollow charge liner has improved penetration performance at long standoff distances from a target, especially at standoff distances greater than three times the width of the groove.

The lower the densities of the primary and secondary initiating liners, the smaller the amount of explosive material required to project these liners at sufficient velocities to initiate the charges on which they impact. For this reason, these liners are preferably of solid, ductile materials having densities of less than 5 gm per cubic cm. Aluminum and alloys thereof have been found to be particularly suitable.

The surface of the cutting charge facing the linear initiating charge is preferably covered by a thin protective layer of non-explosive material, preferably metal, which is sufficiently thin to transmit the energy of initiation from the projected primary liner to the cutting charge. Where the cutting charge incorporates a main charge separated from a secondary charge, the facing surface of the main charge is preferably also similarly protected. This layer on the main charge may also assist in the fabrication of the main charge by for example melt casting, the layer acting as one wall of a vessel which confines the molten explosive material during casting.

BRIEF DESCRIPTION OF THE DRAWINGS

Embodiments of the present invention will now be described by way of example only with references to the accompanying drawings in which.

DETAILED DESCRIPTION OF PREFERRED EMBODIMENTS

Figure 1:
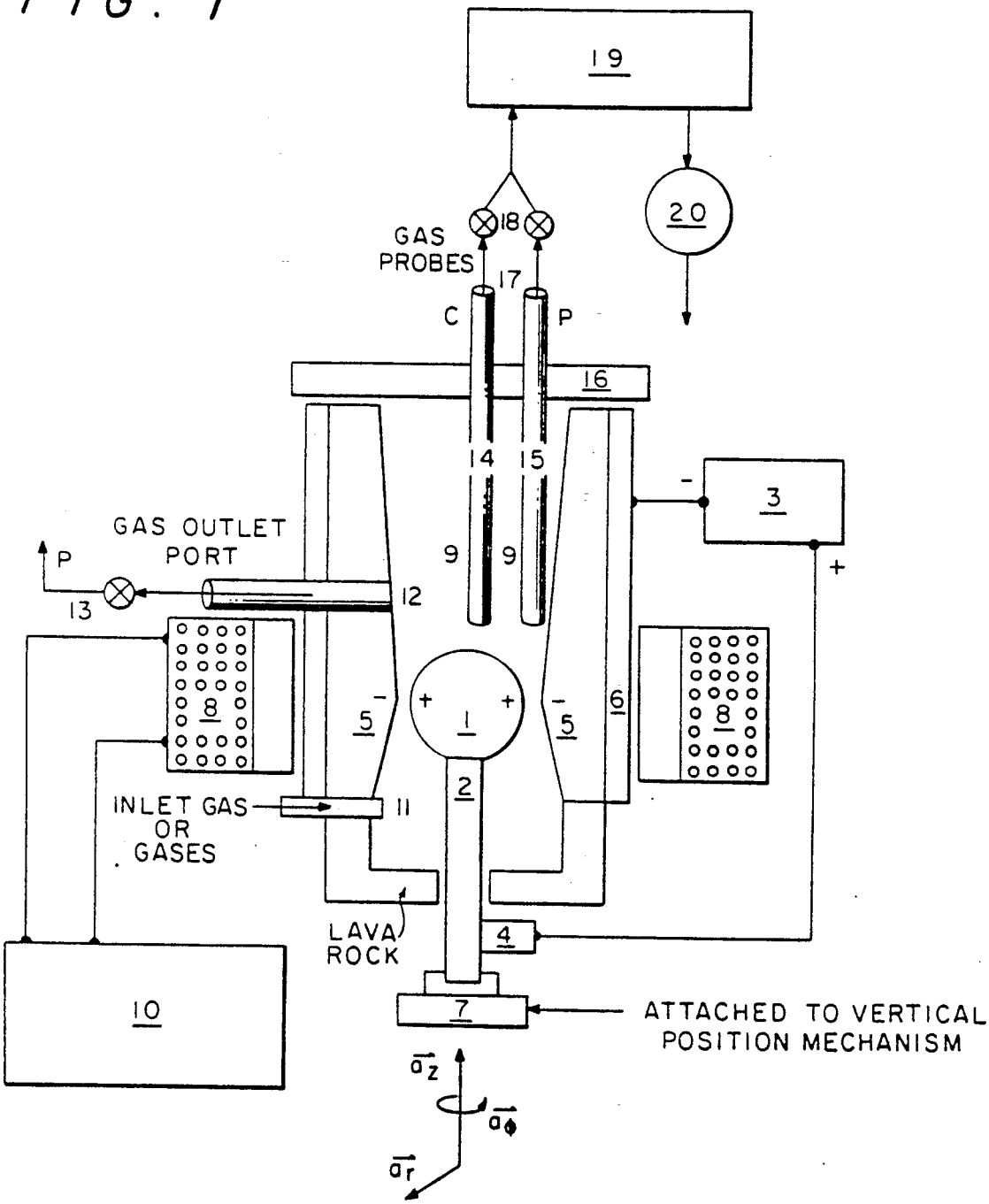
FIG. 1 is a perspective view of a first embodiment of a linear cutting charge device according to this invention which is symmetrically disposed either side of a flat cutting plane and has a hollow charge with a longitudinal cavity in one face along its length in the form of a "V"-shaped groove.

Referring first to FIGS. 1 to 4, a first embodiment of a linear hollow charge device is shown generally at 10. It consists essentially of main charge 12, in the form of a"V" shaped bar, of explosive material supported on a pair of angled side plates 14 and 16 and abutting an end plate 18. The charge 12 has a "V"-shaped groove 20 along its length defined by forward intersecting surfaces 22 and 24 of the charge. The charge 12 is symmetrically disposed either side of a flat cutting plane, represented end-on by line AA', which passes through the apex 26 of the groove 20, and is of constant thickness normal to the surface 22 and 24. The groove 20 is lined with a hollow charge liner 28 of constant thickness non-explosive material.

Supported to the rear of the charge 12 on the side plate 14 and 16 and also abutting end plate 18 are flat planar backing charges 34 and 36 respectively of explosive material each set at an acute angle $\theta_2$ to the angled rear faces 30 and 32 respectively of the charge 12 where they meet the side plates 14 and 16 respectively, to provide air gaps 38 and 40 respectively of uniformly increasing thickness towards the cutting plane. The planes of the charges 34 and 36 extend rearwards to an apex line of intersection along the cutting plane, but the charges themselves stop short of this line and are capped with a bridging charge 42 of explosive material arranged perpendicular to the cutting plane and supported at a fixed distance to the rear of the charge 12. A solid barrier bar 44 is located between the bridging charge 42 and the main charge 12. The faces of the backing charges 34 and 36 opposing the main charge 12 are lined with initiating liners 46 and 48 of non-explosive material which oppose protective receiving liners 50 and 52 of non-explosive material on the rear faces 30 and 32 respectively.

A linear initiating charge 54 of explosive material is supported to the rear of the bridging charge 42 between a rearward portion 18*a* of the end plate 18 located at one end of the main charge 12 and a secondary end plate 56 located at the other end of the main charge. The opposing faces of the linear initiating charge 54 and bridging charge 42 are lined with an initiating strip 58 and a receiving strip 60 respectively of non-explosive material. The position of the charge 54 is so arranged that the planes of the strips 58 and 60 meet at an acute angle $\theta_1$ at the secondary end plate 56, to provide an air gap 61 of uniformly increasing thickness towards the rearward portion 18*a* of the end plate 18. A detonator 62 communicates with one end of the initiating charge 54 through a detonator support 63 and the upper portion 18*a* of the end plate 18.

The end plates 18 and 56 are drawn towards each other by screws 64 and 66 which engage recesses in either end of the support bar 44, thereby providing additional support for the backing charges 34 and 36 and the bridging and linear charges 42 and 54. The assembled device 10 is housed in a sheet metal or plastic protective casing 68 which extends over all parts of the device excluding the first liner 28, the side plates 14 and 16 and the end plate 18.

In use, the assembled device 10 is presented to a target to be penetrated with the hollow charge liner 28 opposing the working surface of the target. A detonation signal is passed to the linear initiating charge 54 through the detonator 62. This creates a detonation wavefront which propagates through the charge 54 towards the second end plate 56, projecting the initiating strip 58 towards the bridging charge 42 as the detonation wavefront passes. The angle $\theta_1$ is selected to ensure that the phase velocity of collision between the strips 58 and 60 in a direction along the length of the bridging charge 42 is virtually infinite, so that the charge 42 is initiated over all parts of its facing surface simultaneously. In this way, the charge 42 linearly initiates both charges 34 and 36 simultaneously along their entire lengths.

A linear detonation wavefront is thereby simultaneously transmitted down each backing charge 34 and 36 towards their respective supporting side plate 14 and 16, projecting the initiating liners 46 and 48 respectively towards the main charge 12 as the wavefront passes. The angle $\theta_2$ is selected to ensure that the phase velocity of collision between the liners 46 and 50 and between the liners 48 and 52 is virtually infinite, so that the the charge 12 is initiated substantially simultaneously over its surface in contact with the receiving liners 50 and 52. The barrier bar 44 prevents premature initiation of the main charge 12 by and directly beneath the already detonated bridging charge 42.

A detonation wavefront is therefore created at the rear of the main charge 12 whose wavefront shape initially conforms to that of the combined shape of the rear faces 30 and 32. This detonation wavefront then propagates through the main charge 12 to the hollow charge liner 28, each element of the wavefront travelling in a direction which is substantially normal to a corresponding portion on the rear face 30 or 32 from which that element of the wavefront was initially transmitted. Since the main charge 12 is of uniform composition and thickness, the detonation wavefront arrives at both forward surfaces 22 and 24 substantially simultaneously, thereby explosively forming the first liner 28 into a cutting-type penetrator having a comparatively low velocity gradient along its trajector, which then penetrates the target along the cutting plane.

One particular linear cutting charge device 10 according to the first embodiment of the present invention has a 15 cm long main charge 12, of a melt- cast HMX (cyclotetramethylenetetranitramine)-based high explosive composition containing small amounts of RDX (cyclotrimethylene-trinitramine) and TNT (trinitrotoluene), which has an apex 26 angle of 90° and a thickness normal to its forward surfaces 22 and 24 of 5.7 cm. The hollow charge liner 28 is constructed in two parts disposed either side of the cutting plane and is of 7 mm thick copper sheet. The backing charges 34, 36, the bridging charge 42 and the linear initiating charge 54 are all cut from 6 mm thick explosive sheet of a plastic explosive composition comprising a mixture of 88% by weight of RDX (cyclotrimethylene trinitramine), 8.4% PIB (Polyisobutylene), 2.4% DEHS (2(Diethylhexyl)-sebacate), and 1.2% PTFE (polytetrafluoroethylene). The liners 46, 48, 50, 52 and strips 58 and 60 are all of 2 mm thick aluminium alloy sheet. The angles $\theta_1$ and $\theta_2$ as determined by the method given below are both approximately 15°.

Figure 4:
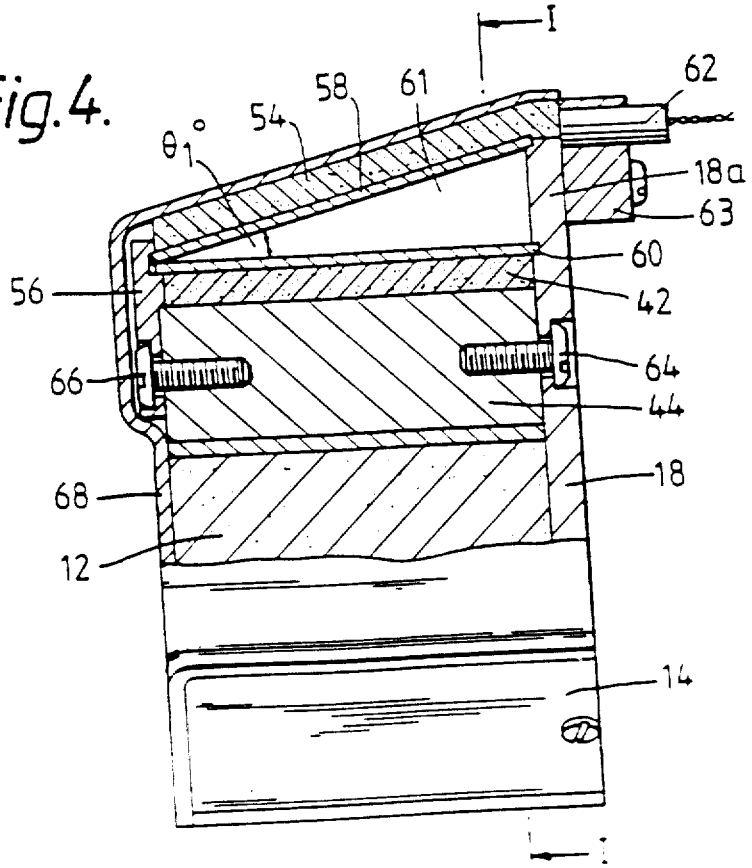
FIG. 4 is a sectional view of the device of FIG. 1 taken along line II—II of FIG. 3.

The method used to determine the angle $\theta_1$ was as follows:

a) select a minimum velocity of projection (V(P)) of the strip 58 sufficient to initiate explosives of the types used in the bridging charge 42 and main charge 12 (2 mm per microsecond selected);
b) select a material type and thickness for the strip 58 (6 mm aluminium alloy sheet selected);
c) using the data from (a) and (b), read off "$\alpha$" from FIG. 4 on page 22 of the article entitled "The Motion of Plates and Cylinders Driven by Detonation Waves at Tangential Incidence" by Hoskin et al (Proceedings of the Fourth Symposium (International) on Detonation, p14–26);

d) calculate the required mass per unit length of initiating charge 54 ($=\alpha X$ mass per unit length of strip 58) derived from the equation on page 21 of Hoskin et al;

e) calculate the required thickness (t) of charge 54 from (d);

f) assuming the strip 58 is projected in a direction normal to the plane of the initiating charge 54, calculate $\theta_1$ from the following equation:

$$\text{Tan } \theta_1 = V(P)/V(D)$$

wherein V(D) is the velocity of detonation of the composition used in the linear initiating charge 54;

g) taking values for t and $\theta_1$ as calculated above, use high speed flask X-ray photography to observe experimentally the projection of the strip 58, and correct $\theta_1$ (where necessary) to ensure a substantially infinite phase velocity of collision between the strips 58 and 60.

Since the backing charges 34,36 and initiating liners 46,48 are of the same materials and thicknesses as the linear initiating charge 54 and strip 58 respectively, $\theta_2$ was given the same value as $\theta_1$ without further calculation or experimentation.

Figure 5:
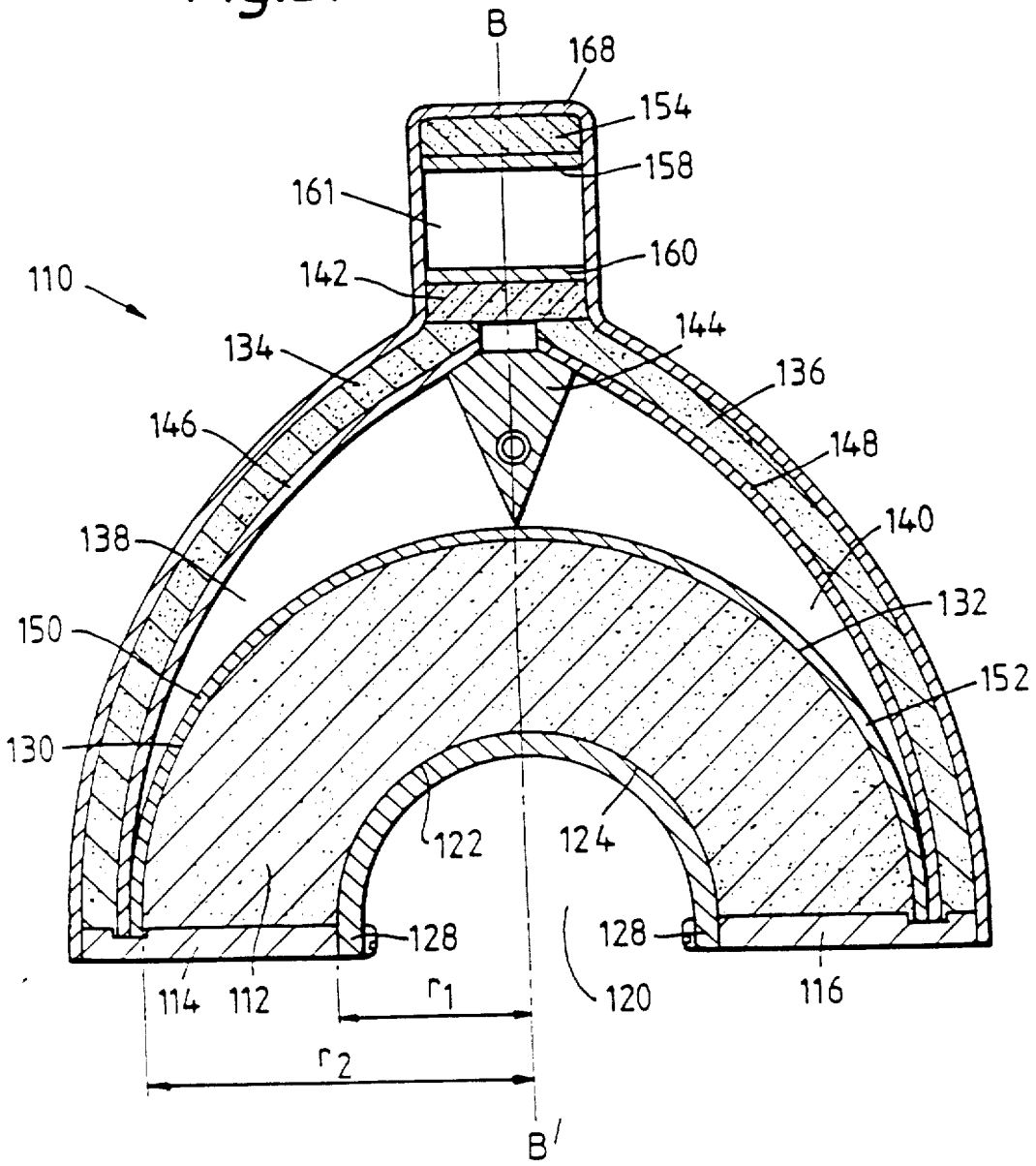
FIG. 5 is a view similar to FIG. 3 of a second embodiment of a linear cutting charge constructed in accordance with the present invention in which the longitudinal cavity in the hollow charge has a semicircular cross section.

In the second embodiment (see FIG. 5), the basic structure and mode of operation are similar to those described above with reference to FIGS. 1 to 4. Accordingly, the same reference numerals as used in FIGS. 1 to 4 but with the prefix "1" have been used in FIG. 5.

In the second embodiment, the main charge 112 is in the form of a hemispherical bar of explosive of external radius r2. The charge 112 has a hemicylindrical groove of radius r1 therein which is defined by its forward surface 122. The charge 112 and groove 120 are symmetrically disposed either side of a flat cutting plane represented end-on by line BB'. The backing charges 134 and 136 of explosive material together have a generally ogival cross-sectional shape across the cutting plane in order to provide gaps between these charges and the main charge 112 of monotonically increasing thickness towards the cutting plane. The arrangements of the bridging charge 142 and linear initiating charge 154 are substantially the same as that described in the first embodiment of the invention.

By using the same materials and thicknesses for the charges 134, 136 and liners 146, 148 as used in the first embodiment of this invention, the degree of curvature of the liners 146, 148 may be determined by maintaining the air gap width as measured normal from the liners 150 and 152 which increases towards the cutting plane at the same monotonical rate as the gap width in the first embodiment.

We claim:

1. Linear hollow charge device comprising:

a longitudinal cutting charge, having a facing surface, of high explosive provided in one or more separate parts, means defining a planisymmetrical groove along one side of the charge which is lined with a non-explosive hollow charge liner, and a means for initiating the cutting charge along its opposite side wherein said means comprises:

a linear initiating charge, having a facing surface, of high explosive disposed along the plane of symmetry adjacent the opposite side of the cutting charge, facing surfaces of the linear initiating charge and said cutting charge defining a gap therebetween which is tapered longitudinally of the cutting charge from one end of the linear initiating charge to its other end, means for locating a detonating means for detonating the linear initiating charge at one end, and a non-explosive primary initiating liner on said facing surface of the linear initiating charge which, when the linear initiating charge is detonated, is projected across the gap to initiate said cutting charge along the plane of symmetry, the degree of taper of the gap being selected such that the phase velocity of cutting charge initiation by the projected initiating liner exceeds the velocity of detonation of the high explosive of the cutting charge.

2. A device according to claim 1 characterised in that the cutting charge is provided in at least two separate parts comprising a main charge having the groove therein, and at least one secondary charge disposed between the main and linear initiating charges and so arranged to initiate the main charge once initiated by the projected primary initiating liner.

3. A device according to claim 2 characterised in that the facing surfaces of the main and at least one secondary charge define a gap therebetween, the facing surface of the at least one secondary charge being at least partly lined with a non-explosive secondary initiating liner which, when the secondary charge is initiated, is projected across the gap to initiate the main charge on its facing surface.

4. A device according to claim 1 characterised in that the primary initiating liner is of a ductile solid material having a density of less than 5 gm $cm^{-3}$.

5. A device according to claim 3 characterised in that the secondary initiating liner is of a ductile solid material having a density of less than 5 gm $cm^{-3}$.

6. A device according to claim 1 characterised in that the facing surface of the cutting charge is covered by a thin protective layer of non-explosive material.

7. A device according to claim 3 characterised in that the facing surface of the main charge is covered by a thin protective layer of non-explosive material.

8. A device according to claim 1 characterised in that the groove is V-shaped in a plane normal to the cutting plane of symmetry.

9. A device according to claim 8 characterised in that the groove is substantially hemicylindrical.

10. A device according to claim 3 characterised in that the main charge is of substantially constant thickness in an direction normal to the surface of the groove.

11. A device according to claim 1 characterised in that the width of the linear initiating charge is less than the width of the cutting charge.

12. A device according to claim 1 characterised in that the groove is rounded in a plane normal to the cutting plane of symmetry.

* * * * *

UNITED STATES PATENT AND TRADEMARK OFFICE

CERTIFICATE OF CORRECTION

PATENT NO. : 5,044,280

DATED : September 3, 1991

INVENTOR(S) : Philippart, et al

It is certified that error appears in the above-indentified patent and that said Letters Patent is hereby corrected as shown below:

The title page should be deleted to appear as per attached title page.

Figure 2:
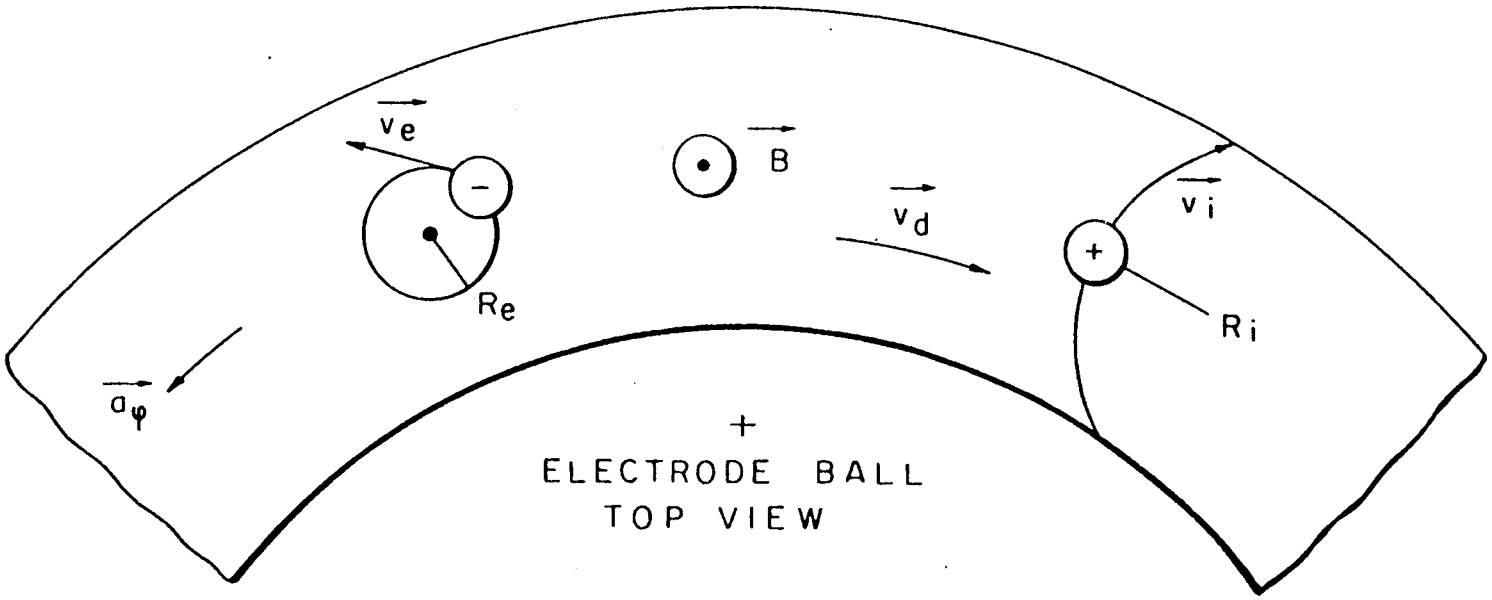
FIG. 2 is a perspective view of a protective hood adapted to fit over the linear cutting charge device of FIG. 1.
Figure 3:
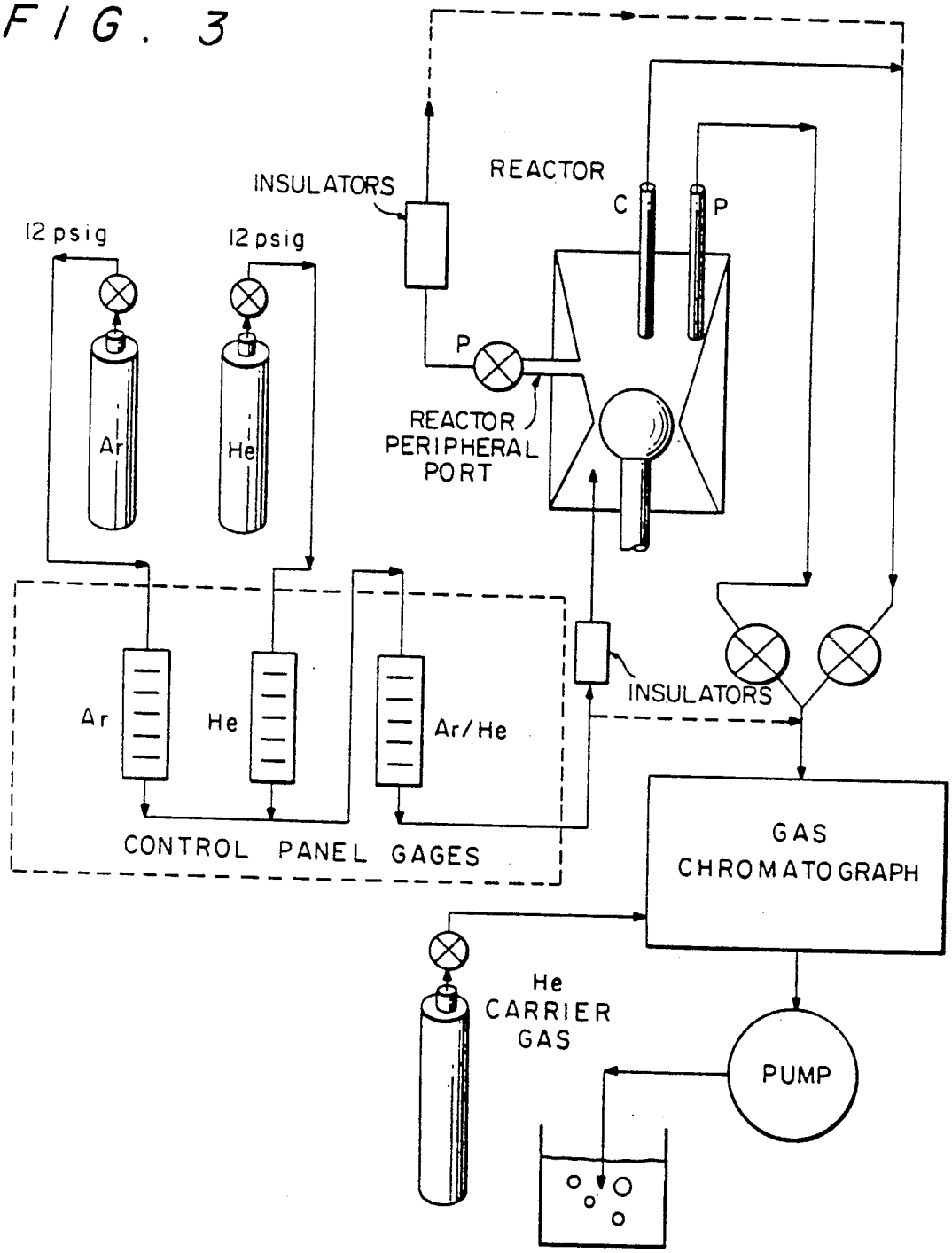
FIG. 3 is a vertical cross section, taken along line I—I of FIG. 4, of the device of FIG. 1 with the hood of FIG. 2 fitted over it in place.
Figure 1:
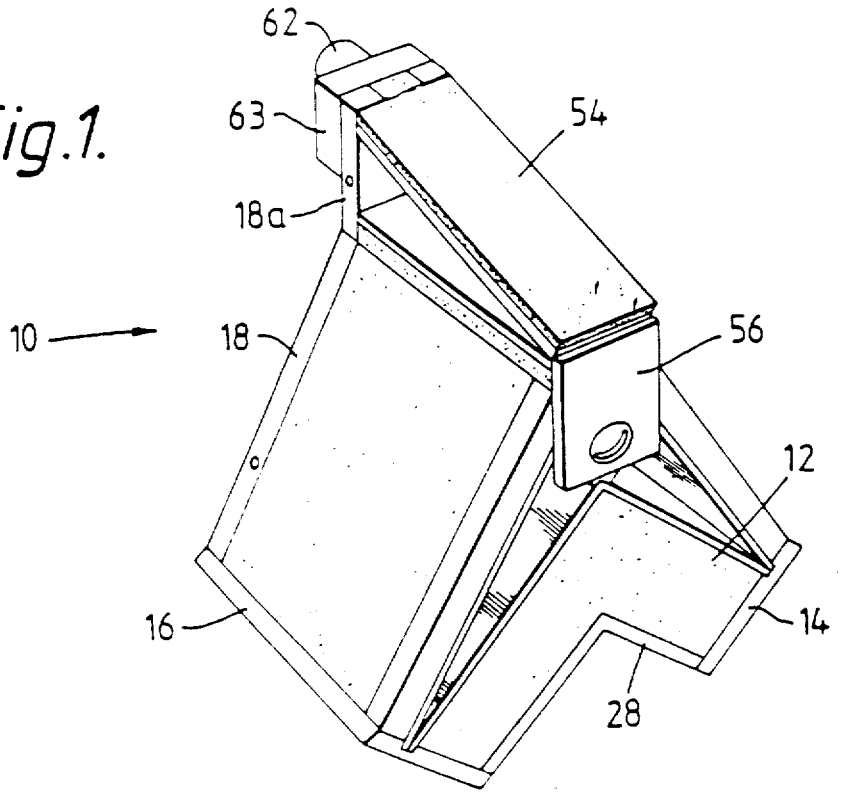
Figure 2:
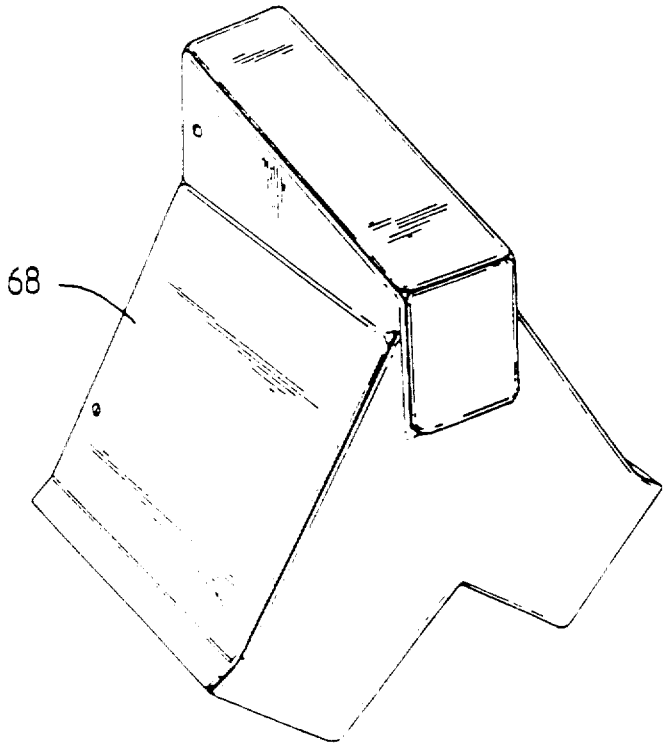
Figure 3:
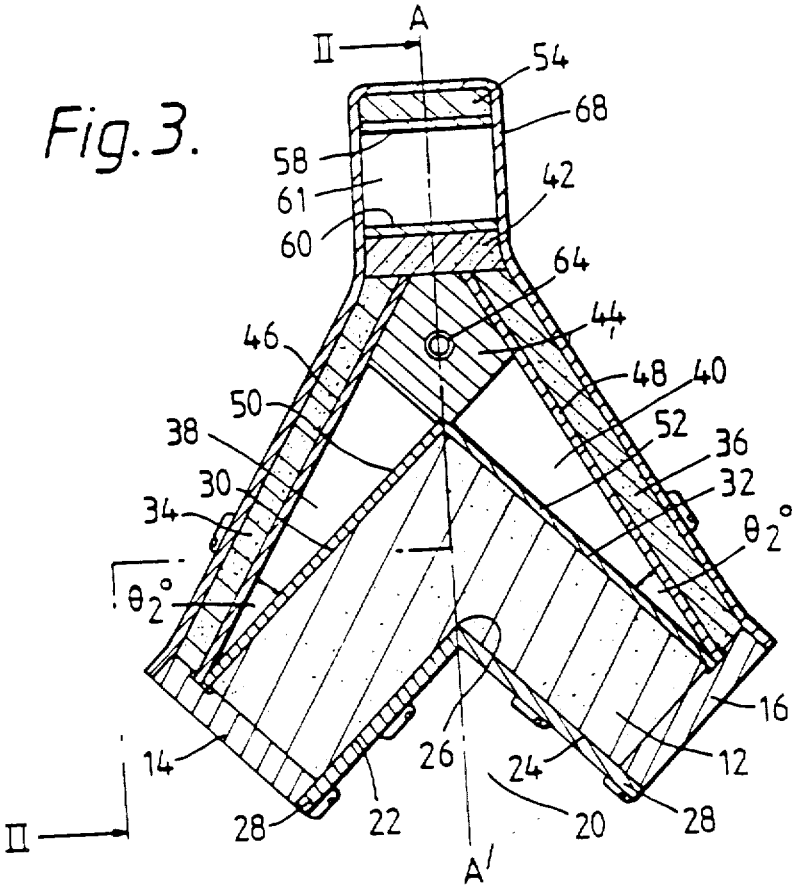

Figures 1-3 should be deleted to be replaced with figures 1-5 as shown on the attached sheets.

Signed and Sealed this

Thirty-first Day of August, 1993

Bruce Lehman

*Attest:*

BRUCE LEHMAN

*Attesting Officer*

*Commissioner of Patents and Trademarks*

United States Patent [19]

Philippart et al.

[11] Patent Number: 5,044,280

[45] Date of Patent: Sep. 3, 1991

[54] LINEAR HOLLOW CHARGE DEVICES

[75] Inventors: Daniel A. Philippart, Redhill; Peter J. Haskins, Kemsing, both of England

[73] Assignee: Secretary of State for Defence in Her Britannic Majesty's Government of the United Kingdom of Great Britain and Northern Ireland, London, United Kingdom

[21] Appl. No.: 476,395

[22] PCT Filed: Nov. 16, 1988

[86] PCT No.: PCT/GB88/01005

§ 371 Date: Jun. 5, 1990

§ 102(e) Date: Jun. 5, 1990

[87] PCT Pub. No.: WO89/04943

PCT Pub. Date: Jun. 1, 1989

[30] Foreign Application Priority Data

Nov. 17, 1987 [GB] United Kingdom ..... 8726912

[51] Int. Cl.[5] ..... F42B 1/00; F42B 1/02

[52] U.S. Cl. ..... 102/307; 102/308; 102/476; 102/318; 102/701; 175/4.6

[58] Field of Search ..... 102/307, 312, 313, 314, 102/306, 308, 309, 310, 476, 475, 701, 318; 89/1.15; 175/4.6, 2, 3; 166/55, 55.2

[56] References Cited

U.S. PATENT DOCUMENTS

| | | | |
|---|---|---|---|
| 3,136,249 | 6/1964 | Poulter | 102/24 |
| 3,211,094 | 10/1965 | Liddiard, Jr. | 102/22 |
| 3,238,019 | 3/1966 | DeCarli | 23/209.1 |
| 3,443,518 | 5/1969 | Cross | 102/24 |
| 4,187,782 | 2/1980 | Grace | 102/56 |

FOREIGN PATENT DOCUMENTS

| | | |
|---|---|---|
| 0254800 | 2/1988 | European Pat. Off. . |
| 842035 | 6/1951 | Fed. Rep. of Germany . |
| 1796234 | 8/1971 | Fed. Rep. of Germany . |
| A2138111 | 10/1984 | United Kingdom . |
| A2176878 | 1/1987 | United Kingdom . |

*Primary Examiner*—Brooks H. Hunt
*Assistant Examiner*—Chrisman D. Carroll
*Attorney, Agent, or Firm*—Nixon & Vanderhye

[57] ABSTRACT

The device (10) consists of a bar (12) of high explosive having a planisymmetrical groove (20) along one side lined with a hollow charge liner (28). A pair of backing charges (34, 36) connected by a bridging charge (42) are disposed along the opposite side of the bar. Each backing charge is separated from the bar by a gap (38, 40) which tapers towards the common longitudinal periphery of the bar and charge. The surfaces of the backing charges facing the gaps are lined with liners (46, 48). A linear initiating charge (54) is separated from the bridging charge longitudinally of the device by a gap (61). The facing surface of the charge (54) is lined with a metal strip (58) which, when the charge is detonated, is projected across the gap (61) to initiate the bridging charge linearly. A detonation wave then propagates from the bridging charge down each backing charge towards its peripheral region, projecting the liners (46, 48) across the gaps (38, 40) to initiate the bar. A detonation wavefront is thereby initiated along the length of the opposite side of the bar (12) which then propagates through the bar to form the hollow charge liner (28) into a linearly-projected cutting jet of high penetration efficiency.

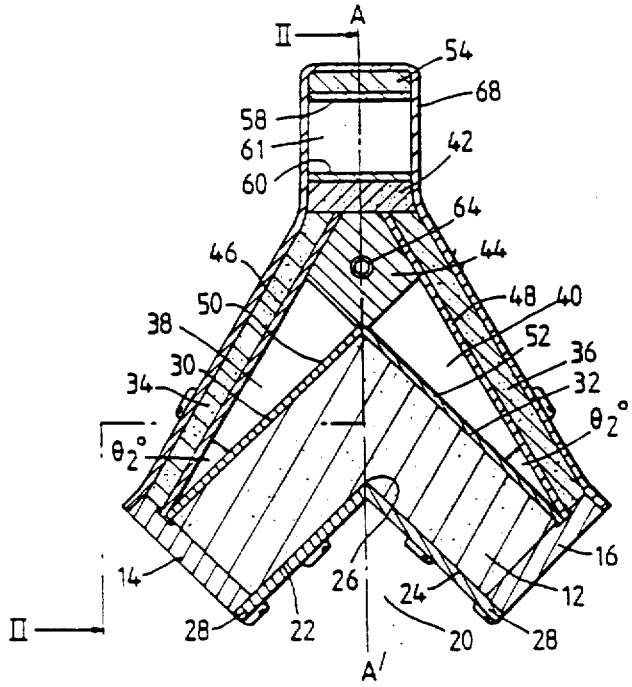

12 Claims, 3 Drawing Sheets